US005857670A

United States Patent [19]

Jung

[11] Patent Number: 5,857,670

[45] Date of Patent: Jan. 12, 1999

[54] PAPER ARRANGING AND POSITIONING MECHANISM IN A SORTER WITH A STAPLER

[75] Inventor: Yeon Kwan Jung, Seoul, Rep. of Korea

[73] Assignee: Sindo Ricoh Co., Ltd., Rep. of Korea

[21] Appl. No.: 689,414

[22] Filed: Aug. 9, 1996

[30] Foreign Application Priority Data

Aug. 10, 1995 [KR] Rep. of Korea ..... 95-24679

[51] Int. Cl.[6] ..... B65H 39/02

[52] U.S. Cl. ..... 270/58.12; 270/58.16; 270/58.27

[58] Field of Search ..... 270/58.08, 58.11, 270/58.12, 58.16, 58.17, 58.27, 58.28

[56] References Cited

U.S. PATENT DOCUMENTS

| | | | |
|---|---|---|---|
| 5,031,890 | 7/1991 | Hosoi et al. | 270/53 |
| 5,092,509 | 3/1992 | Naito et al. | 270/58.16 X |
| 5,169,134 | 12/1992 | Ishiguro et al. | 270/58.16 |
| 5,384,634 | 1/1995 | Takehara et al. | 270/58.27 X |

*Primary Examiner*—Hoang Nguyen
*Attorney, Agent, or Firm*—Sheridan Ross PC

[57] ABSTRACT

An improved paper arranging and position mechanism, including a sorter with a stapler, for arranging paper stacks loaded on a plurality of bins and for moving the arranged paper stacks into an opening portion of a stapler, while retaining other paper stacks on other bins.

6 Claims, 7 Drawing Sheets

PAPER ARRANGING AND POSITIONING MECHANISM IN A SORTER WITH A STAPLER

BACKGROUND OF THE INVENTION

1. Field of the Invention

The present invention relates to a sorter with a stapler on a copier, printer and the like, and more particularly to a paper arranging and positioning mechanism for stapling papers copied or printed.

2. Description of Related Art

Generally, a sorter with a stapler is provided with not only a function of sorting paper sheets driven out of a copier but also a function of binding the sorted paper sheets. If the paper sheets distributed and stacked onto bins are not arranged neatly and then positioned at a region where they can be bound by a stapler before stapling, the stapler can not trimly bind the stacked paper sheets. Thus, the operation of arrangement and position must be made before the stapling operation in order that the stapler can properly perform its function. Therefore, various paper arranging and positioning mechanisms have been designed for carrying out these operations.

As for a mechanism having such functions as neatly arranging and positioning the paper sheets and then stapling the paper sheets, U.S. Pat. No. 5,031,890 discloses a sorter with a stapler, as shown in FIG. 1A and FIG. 1B, having construction of the pivoting device 500 and the stapling device 400. The pivoting device 500 has pushing members for positioning or neatly arranging paper sheets on the bins and a device for shifting each pushing member to a position which matches the paper size. The stapling device 400 is made up of the stapler 401, the chuck section 421 for pulling a stack of paper sheets 301 toward the stapler 401, and a mechanism for moving the stapler 401 and the chuck section 421 up and down to any one of the bins 400.

However, in this sorter with a stapler, the movement of paper stacks from the initial position on the bin to the stapling position is executed by two separate mechanisms, one of which is the pivoting device 500 for arranging and positioning the paper stacks loaded on each bin, the other of which is the stapling device 400, including the chuck section 421, for pulling the positioned stack of paper sheets on the particular bin into the stapler 401. Thus, the construction of the mechanisms is so complicated that the number of components thereof is increased, and as a result, the cost of production is high.

SUMMARY OF THE INVENTION

Therefore, the present invention has been conceived to overcome the aforementioned problem and has an object to provide an improved paper arranging and position mechanism in a sorter with a stapler, which is simply constructed to arrange paper stacks loaded on each bin and move the arranged paper stack on a particular bin into the opening portion of the stapler while retaining paper stacks on other bins.

In order to achieve the above-specified object, according to the present invention, there is provided a paper arranging and positioning mechanism in a sorter with stapler, including a plurality of bins formed with a first notched portion at one side thereof and with a second notched portion at the other side thereof, comprising: a jogging means movably in a horizontal direction and rotatably arranged upright throughout said first notched portion in said bins, and having some of its portion abutting against the paper sheets on the bin which is in the stapling position protruded by a predetermined length so that said jogging means is formed with a prominent portion for jogging the paper sheets toward the stapler by its pivoting motion; an arranging means rotatably arranged upright throughout said second notched portion on said bins, and having some of its portion protruded by a predetermined length so that said arranging means is formed with a prominent portion for allowing the leading end of the paper sheets pushed by the pivoting motion of said jogging means to enter the opening portion of the stapler as it pivots; a means for driving said jogging means back and forth along said first notched portion; and a means for rotating said jogging means and said arranging means.

BRIEF DESCRIPTION OF THE ATTACHED DRAWINGS

Other features in structure, operation and advantages of the present invention will become more apparent to those skilled in the art from the following descriptions when read in conjunction with the accompanying drawings, in which.

DETAILED DESCRIPTIONS OF A PREFERRED EMBODIMENT

Hereinafter, the paper arranging and positioning mechanism for the sorter according to the present invention will be described in detail with an embodiment with reference to FIGS. 2 to 6.

Figure 1A:
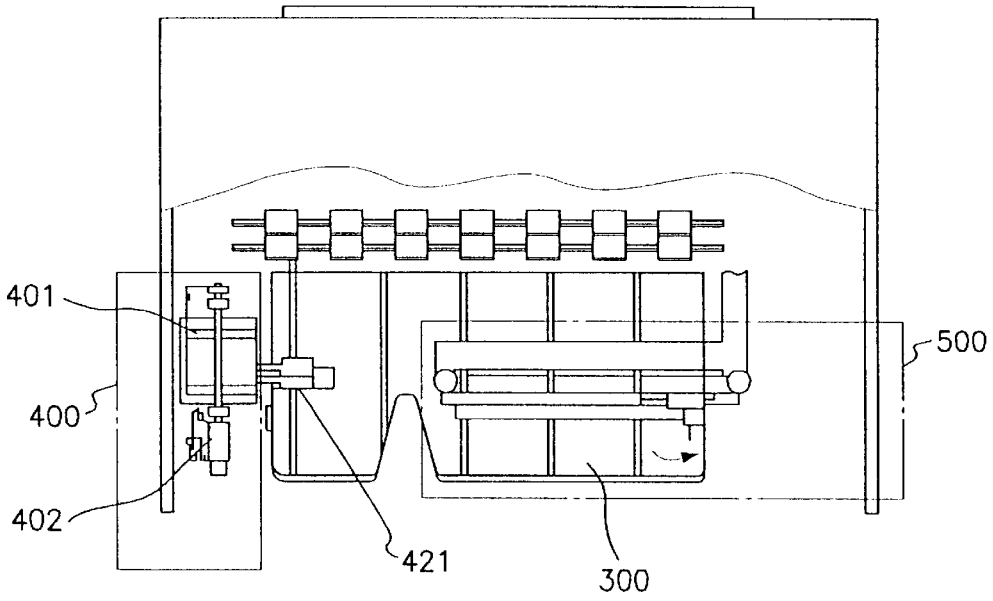
FIG. 1A (Prior Art)
FIG. 1A is a plan view showing a stapling device and a pivoting device mounted on the sorter with a stapler of the prior art.
Figure 1B:
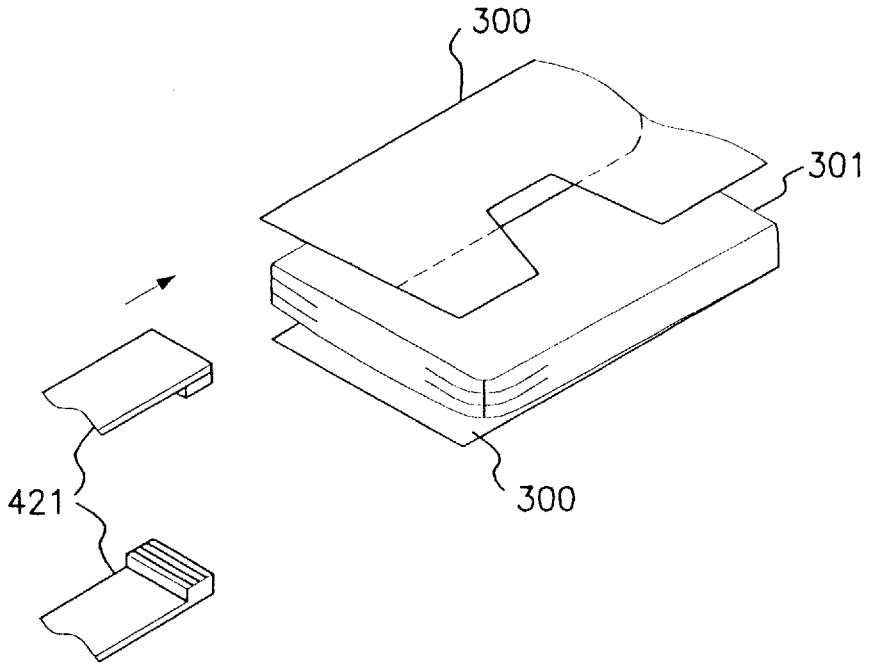
FIG. 1B (Prior Art)
FIG. 1B is a view showing the operation of a chuck of the stapling device of the prior art.
Figure 2:
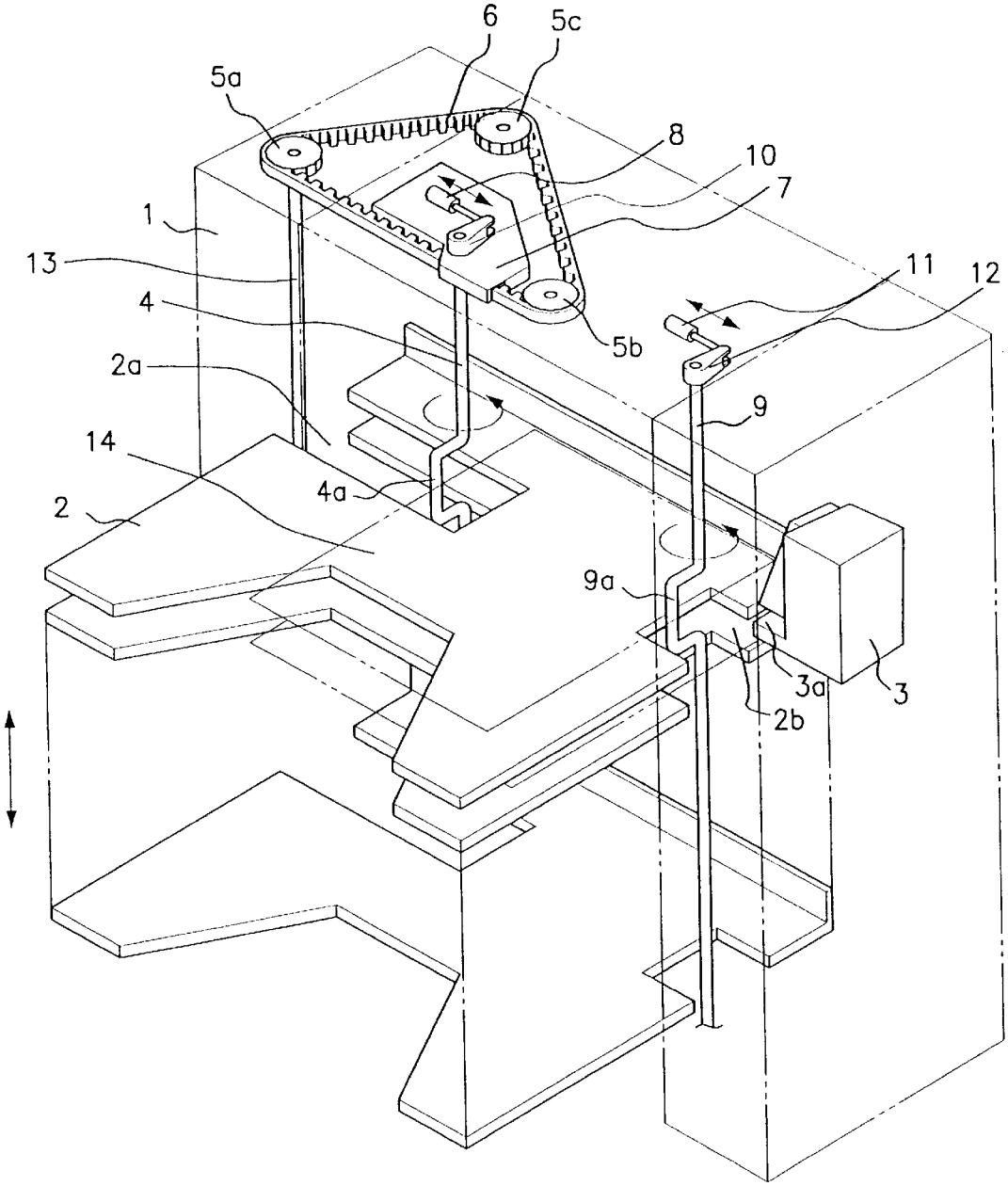
FIG. 2 is a perspective view showing the overall construction of the sorter with a stapler according to the present invention.

Referring to FIG. 2, the paper arranging and positioning mechanism in a sorter with a stapler is generally divided into a plurality of bins located at an outlet for receiving copy sheets which are sequentially driven out of a copier and is movable up and down by a predetermined sorting mode, a device for arranging the paper stacks loaded on individual bins neatly and then moving the arranged paper stack onto a position where it can be bound, and a stapler for binding the paper stack.

The plurality of bins will be now described. The bins are arranged one above another and in parallel to each other. Each bin 2 is formed at its one side portion with the first notched portion 2*a* which extends over a predetermined length from the edge thereof toward the center portion thereof, and is formed with the second notched portion 2*b* at its other side portion.

Next, the device for arranging and moving paper stacks on bins comprises the jog bar 4 for pushing one end of the paper stacks toward a stapler, the arrange bar 9 for arranging a leading end of the paper stacks which is pushed by the jog bar 4, at driving part for moving the jog bar 4 in horizontal direction, a pivoting part for rotating the two bars 4 and 9.

The jog bar 4 has its predetermined portion protruded in parallel to its axial line so that it is formed with the prominent portion 4*a* like a crankpin, thus taking the shape of a single throw crankshaft. The jog bar 4 is arranged upright throughout the first notched portion 2*a* on each bin 2, which is a movable member not only to be reciprocated back and forth along the notched portion 2*a* but also to be rotatable for pushing the paper stacks.

Similarly, the arrange bar 9 has its predetermined portion protruded in parallel to its axial line so that it is formed with the prominent portion 9*a*, and formed into an identical shape with the jog bar 4. The arrange bar 9 is arranged vertically throughout the second notched portion 9*a* for arranging the paper stacks by abutting against the leading end of those that are pushed by the jog bar 4.

In addition, the width of the two notched portions 2*a* and 2*b*, which are formed at both side portions of bins 2, are determined to have such a size that they can receive the pivotal range established by the rotary motion of the prominent portions 4*a* and 9*a* when the jog bar 4 and the arrange bar 9 rotate.

In addition, the prominent portions 4*a* and 9*a* of the tow bars 4 and 9 have their extending length in parallel to an axial line corresponding to the distance between the upper bin and the lower bin, which are adjacent to a bin, and have their protruding length in perpendicular to an axial line corresponding to the distance between an axial line of the arrange bar 9 and a stapling position, that is the length such that the leading end of the paper stack in an arranging state is advanced to a position where it can be stapled The driving part for moving the jog bar 4 in horizontal direction includes a motor(not shown), the driving shaft 13, the plurality of pulleys 5*a*, 5*b* and 5*c* arranged at the upper region of the body 1, the timing belt 6 connecting the pulleys 5*a*, 5*b* and 5*c*, and the bracket 7 connected to a predetermined portion of the timing belt 6. The motor mounted at the lower portion of the body 1 transmits its driving force to the pulley 5*a* through the driving shaft 13, which is reversible in rotation and rotates by a predetermined number of rotations, thereby the pulley 5*a* comes to rotate as a driving pulley. The pulleys 5*a*, 5*b* and 5*c* are spaced apart from one another by a predetermined distance in an identical plane and the timing belt 6 is passes over them, so the timing belt 6 is circled around the pulleys 5*a*, 5*b* and 5*c* by the rotation of the driving pulley 5*a*. As a result, the bracket 7, which has its one side portion anchored to the timing belt 6 between the pulleys 5*a* and 5*c*, while being mounted slidably at the upper region of the body 1 and in the space formed by connecting the pulleys 5*a*, 5*b* and 5*c* can be moved integrally with the timing belt 6 back and forth by the rotating direction of the motor.

As the bracket 7 moves forward toward the arrange bar 9, the jog bar 4, which has it one end supported to the bracket 7, comes to make for the paper stacks on each bin 2, and then pushes one end of them. Therefore, one end of the paper stacks 14 on individual bins 2 are pushed toward the arrange bar 9 by the forward movement of jog bar 4, so that the other end comes to abut against the arrange bar 9, and as a result, the leading end of the paper stacks are arranged neatly. At this time, the movement direction of the bracket 7 depends on the rotating direction of the motor, and the distance of movement depends on the number revolutions of the motor, that is determined such that the distance between the jog bar 4 moving forward and the stationary arrange bar 9 can be in matching relation to the paper size on the bins 2.

The pivoting part for rotating the two bars 4 and 9 includes the first solenoid 8 mounted on the bracket 7 for providing the jog bar 4 with a pivotal force, the first lever 10 for converting the rectilineal motion of the solenoid 8 into the rotary motion of the jog bar 4, the second solenoid 11 mounted on the upper of the body 1 for providing the arrange bar 4 with a pivotal force, the second lever 12 for converting the rectilineal motion of the solenoid 11 into the rotary motion of the arrange bar 9. The solenoids 8 and 11 are actuated, when they are energized, so that one end of the levers 10 and 12 are pulled, and as a result, the two bars 4 and 9, which are fitted to the other end of the levers, are respectively caused to rotate by a quarter rotation (90 degrees).

As the jog bar 4 and the arrange bar 9 come to rotate, the prominent portion 4*a* of the jog bar 4 pivots about an axial line of the jog bar 4 to jog one end of the paper stacks on the bin 2 toward the stapler 3, at the same time, the prominent portion 9*a* of the arrange bar 9 pivots about an axial line of the arrange 9 to allow the other end of the paper stack to be advanced toward the stapler 3. At this time, only the paper stack on the bin where the prominent portions 4*a* and 9*a* of the two bars 4 and 9 are deposited is urged toward stapler by the pivotal motion of the prominent portion 4*a*, and then are positioned at the opening portion 3*a* of the stapler 3, while the paper stacks on the other bins are retained in their arranging states.

Next, the stapler 3 is arranged at the one side of the bins 2. The stapler drives a staple into one end portion of the paper stack which is urged and positioned onto the opening portion 3*a* of the stapler 3 by the pivoting motion of the prominent portion 4*a*.

Hereinafter, the operation of the paper arranging and positioning mechanism in a sorter with a stapler according to the present invention will be described with reference to FIGS. 3 to 6.

Figure 3:
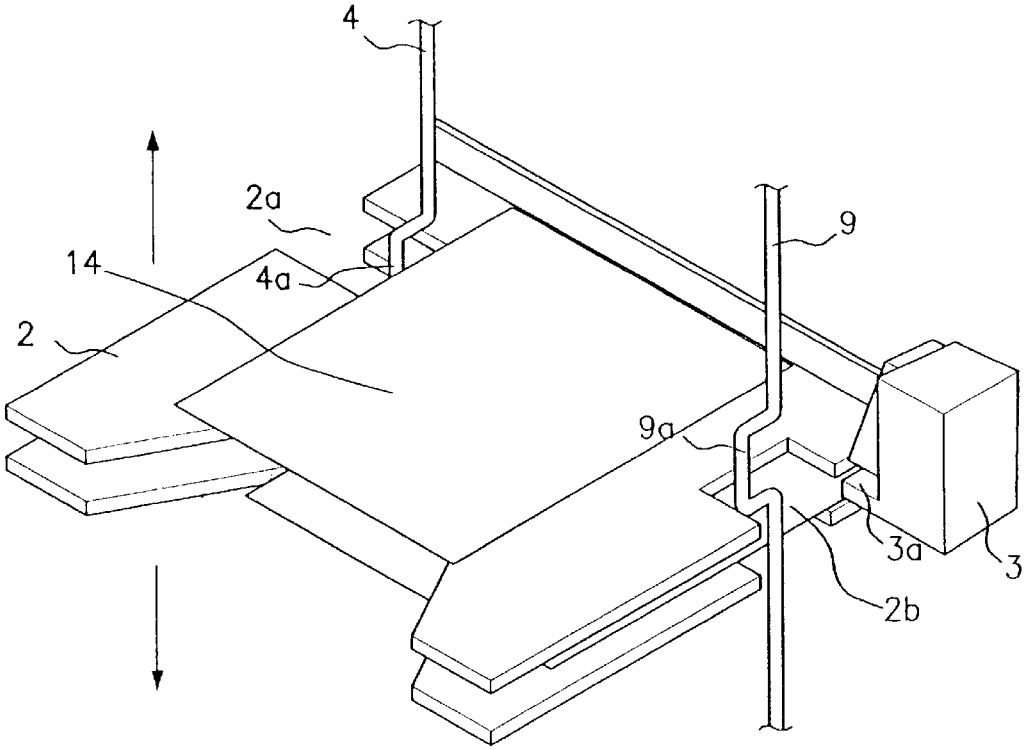
FIG. 3 is a view showing the state of paper stacks loaded on the bins before they are arranged in the sorter with a stapler according to the present invention.
Figure 4:
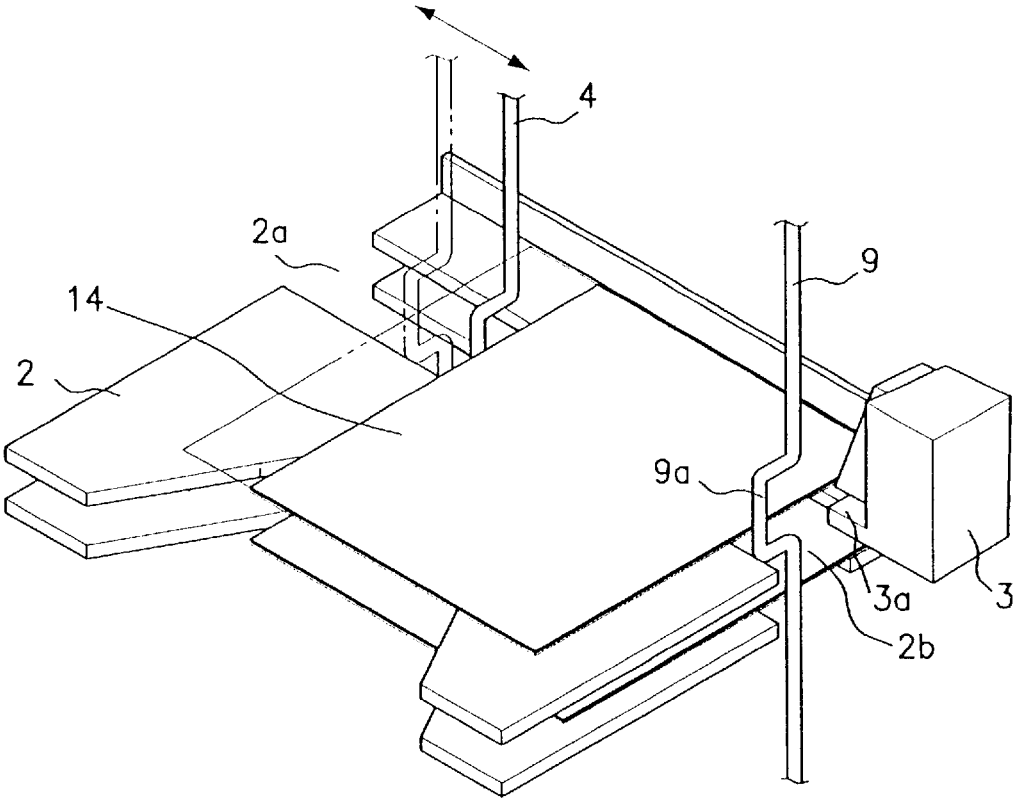
FIG. 4 is a view showing the arranged state of the paper stacks in the sorter with a stapler according to the present invention.
Figure 5:
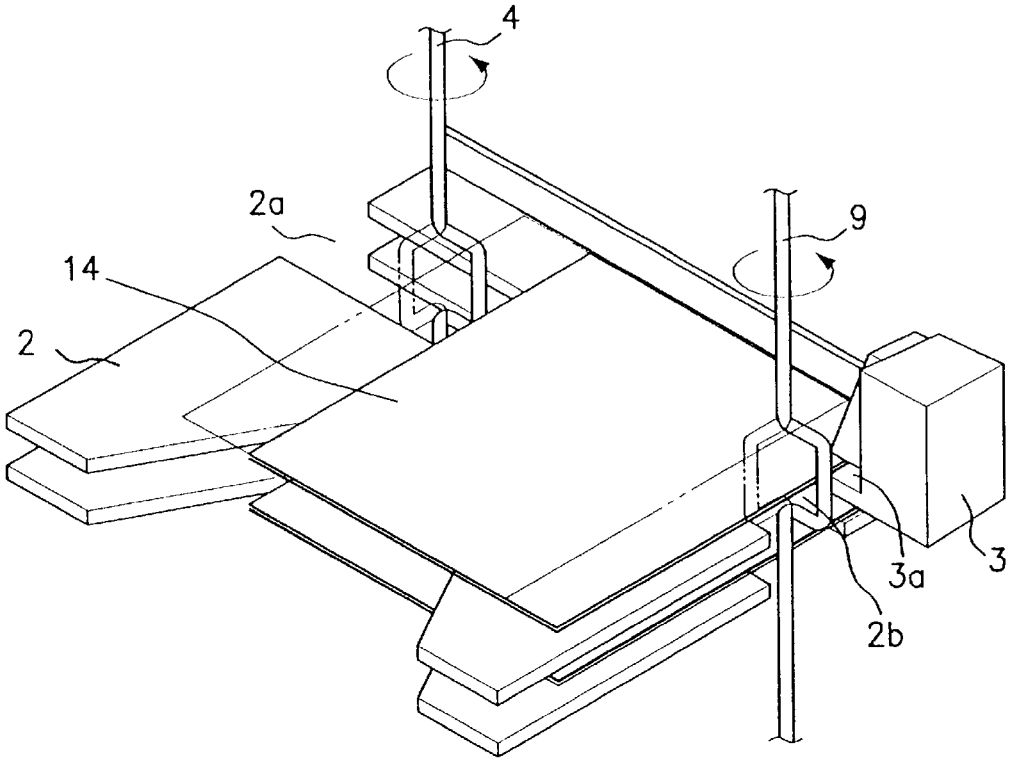
FIG. 5 is a view showing the positioned state of the paper stacks for stapling in the sorter with a stapler according to the present invention.
Figure 6A:
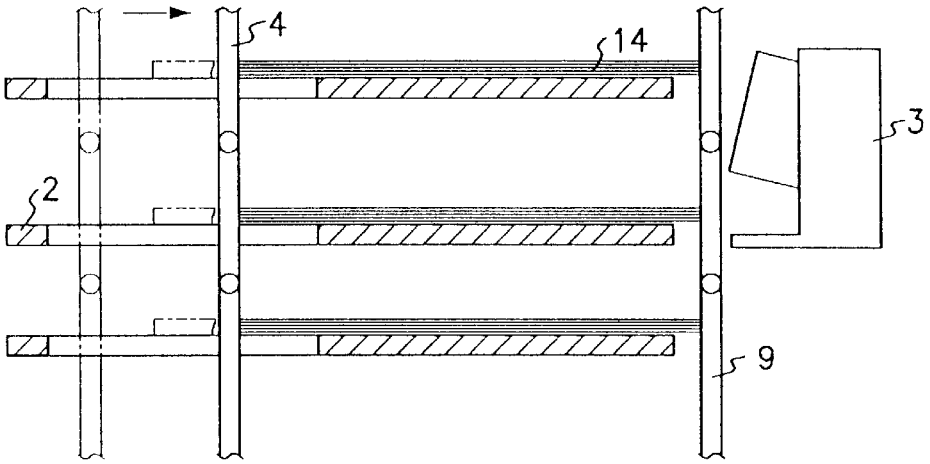
FIGS. 6A, 6B and 6C are schematic side elevation views showing the working states of the sorter with a stapler according to the present invention.
Figure 6B:
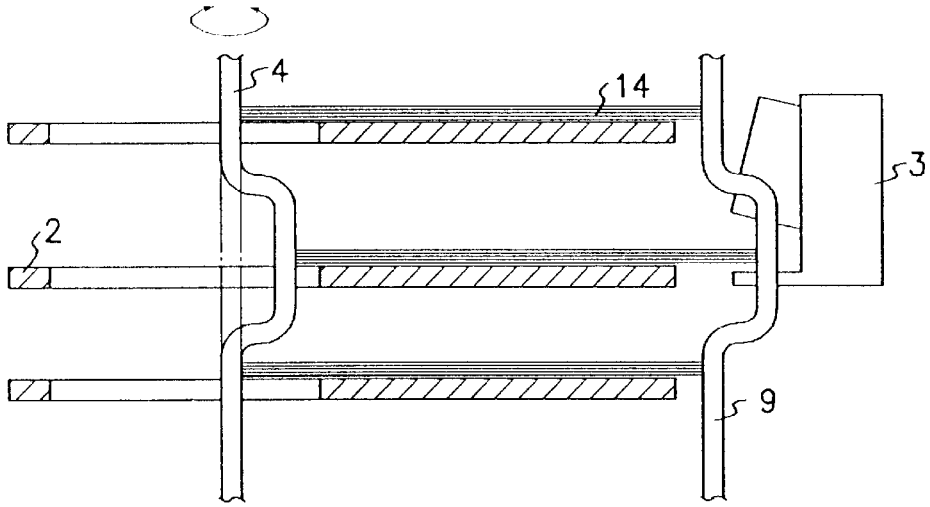
Figure 6C:
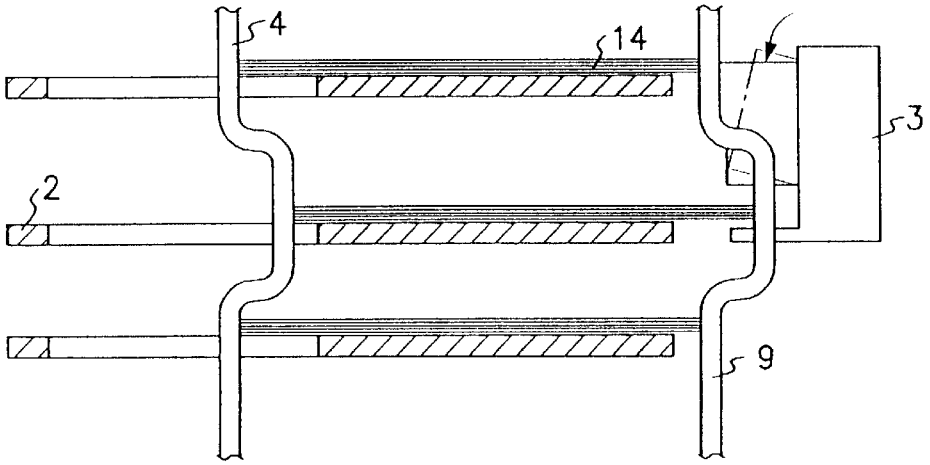

FIG. 3 is a view showing the stale of the paper stacks loaded on bins before they are arranged in the sorter with a stapler according to the present invention, FIG. 4 is a view showing the arranged state of the paper stacks in the sorter with a stapler according to the present invention, FIG. 5 is a view showing the positioned state of the paper stacks in the sorter with a stapler according to the present invention, and FIGS. 6A, 6B and 6C are schematic side elevation views showing the working states of the sorter with a stapler in stages according to the present invention.

When the paper sheets are driven out of the copier, the bins of the sorter moves up and down according to a predetermined sorting mode and then, as shown FIG. 3, the paper sheets are distributed onto the individual bins and prepared for paper stacks loaded on each bin in order of page.

When the sorting operation is completed, a motor(not shown) mounted on the lower of the sorter body 1 comes to rotate by a predetermined number of revolutions. The driving force of the motor is transmitted to the pulley 5*a* through the driving shaft 13 thereby moving the timing belt 6 to pass over the plurality of pulleys 5*a*, 5*b* and 5*c*. Since the bracket 7 is mounted slidably on the upper portion of the body 1 while having its one side portion anchored to the timing belt 6, it can be slided back and forth in a horizontal direction by the rotation of the motor.

Thus, the jog bar 4, which has its end portion supported in perpendicular to the bracket 7, as shown FIG. 4, moves along the first notched portions 2*a* in the bins 2, and jogs the one side of paper stacks 14 to bring the other side of paper stacks into abutment against the arrange bar 9. At this time, since the arrange bar 9 is a stationary member fixed to an opposite side to the jog bar 4, the paper stacks on the individual bins can be arranged neatly before stapling as shown FIGS. 4 and 6A.

After the paper stacks 14 on the bins 2 are arranged, the first solenoid 8 and the second solenoid 9 are actuated at the same time according to the stapling mode, thus pulling one end of the first and second levers 10 and 12 causing the jog bar 4 and the arrange bar 9 to be rotated a quarter rotation (90 degrees), as shown in FIG. 5. As a result, the prominent portion 4*a* of the jog bar 4 in rotation comes to jog the one side of the paper stack toward the stapler 3, and at the same time, the arrange bar 9 is rotated by a quarter rotation allowing the leading end of the paper stack not to abut against the arrange bar 9. Therefore, the paper stack 14, which is pushed by the pivotal motion of the prominent portion 4*a*, can be urged toward the stapler 3 without any obstruction of the arrange bar 9, and the leading end of it can be positioned at the opening portion 3*a* of stapler 3 with ease. And then, the stapler 3 is actuated, when it is energized, to drive a staple into the end portion of the paper stack thereby binding the paper stack. At this time, as shown in FIGS. 6B and 6C, the paper stacks on the upper and lower bins, except for the bin in which the prominent portions 4*a* or 9*a* of the two bars 4 and 9 lie, are retained in their arranging states.

After the stapling operation is completed, the jog bar 4 and the arrange bar 9 are rotated by the reversal of the motor so that they return to their original arranging states, as shown FIGS. 4 and 6A. Thereby, the stapled paper stack is pushed backward to its original arranging state by the prominent portion 9*a* of the arrange bar 9 which is reversed.

And then, the next bin is shifted upward to a position where the stapler can perform its operation, and another paper stack thereon is stapled in the above-described manner. Such a sequence of steps is repeated with other bins.

Therefore, according to the present invention, since the device for arranging the paper stacks and the device for pushing the arranged paper stacks into the stapler need not to be prepared separately, the construction of the mechanism call be simplified, thereby the cost of manufacture may be lowerd.

Therefore, it should be understood that the present invention is not limited to the particular embodiment disclosed herein as the best mode contemplated for carrying out the present invention and is not limited to the specific embodiments described in this specification except as defined in the appended claims.

What is claimed is:

1. A paper arranging and positioning mechanism in a sorter with stapler and a plurality of bins having a first notched portion at one side thereof and a second notched portion at the other side thereof, comprising:

a jogging means movably, in a horizontal direction, and rotatably arranged upright throughout said first notched portion in said bins, and having a first prominent portion which is abutting against the paper sheets on said bin in the stapling position, wherein said first prominent portion is protruded from the axis of said jogging means by a predetermined length, so that said first prominent portion jogs the paper sheets toward the stapler by pivoting motion of said jogging means;

an arranging means rotatably arranged upright throughout said second notched portion on said bins, and having a second prominent portion which is protruded from the axis of said arranging means by a predetermined length, so that said second prominent portion allows the leading end of the paper sheets pushed by the pivoting motion of said jogging means to enter the opening portion of the stapler by the pivoting motion of said arranging means;

a first means for driving said jogging means back and forth along said first notched portion; and a second means for rotating said jogging means and said arranging means.

2. The mechanism according to claim 1, wherein said first and second notched portions are formed into a size for receiving the rotary range of said prominent portions of said jogging means and said arranging means.

3. The mechanism according to claim 1, wherein said first prominent portion has its extending length, in parallel to the axial line of said jogging means, corresponding to the distance between the upper bin and the lower bin, which is adjacent to one bin, and has its protruding length, in perpendicular to the axial line of said jogging means, corresponding to the distance between the leading end of paper stack in an arranging state and the opening portion of a stapler, said second prominent portion has its extending length, in parallel to the axial line of said arranging means, corresponding to the distance between the upper bin and the lower bin, which is adjacent to one bin, and has its protruding length, in perpendicular to the axial line of said arranging means, corresponding to the distance between the leading end of paper stack in an arranging state and the opening portion of a stapler.

4. The mechanism according to claim 1, wherein said first means includes a plurality of pulleys which are spaced apart from one another by a predetermined distance in an identical plane, a timing belt passing over said plurality of pulleys, and a bracket having its one side portion anchored to said timing belt while supporting one end of said jogging means.

5. The mechanism according to claim 1, wherein said second means includes a first solenoid being actuated by energizing for rotating said jogging means, a second solenoid being actuated by energizing for rotating said arranging means, a first lever having its one end portion fixed to one end of said jogging means and having its other end portion connected to the shaft of said first solenoid, a second lever having its one end portion fixed to one end of said arranging means and having its other end portion connected to the shaft of said second solenoid.

6. A paper arranging and positioning mechanism in a sorter with stapler, comprising:

a jogging means movably, in a horizontal direction, and rotatably arranged upright throughout a first notched portion in a bins, and having a first prominent portion which is abutting against the paper sheets on the bin in the stapling position, wherein said first prominent portion is protruded from the axis of said jogging means by a predetermined length, so that said first prominent portion jogs the paper sheets toward the stapler by pivoting motion of said jogging means;

an arranging means rotatably arranged upright throughout a second notched portion on said bins, and having a second prominent portion which is protruded from the axis of said arranging means by a predetermined length, so that said second prominent portion allows the leading end of the paper sheets pushed by the pivoting motion of said jogging means to enter the opening portion of the stapler by the pivoting motion of said arranging means;

a first means for driving said jogging means back and forth along said first notched portion; and a second means for rotating said jogging means and said arranging means.

* * * * *